US008820244B2

(12) United States Patent
Prelic et al.

(10) Patent No.: US 8,820,244 B2
(45) Date of Patent: Sep. 2, 2014

(54) ACTIVATION UNIT FOR MUNITIONS-FREE DECOY TARGET

(75) Inventors: Nenad Prelic, Anger (DE); Heribert Eglauer, Berchtesgaden (DE)

(73) Assignee: Rheinmetall Waffe Munition GmbH, Unterluess (DE)

( * ) Notice: Subject to any disclaimer, the term of this patent is extended or adjusted under 35 U.S.C. 154(b) by 0 days.

(21) Appl. No.: 13/435,405

(22) Filed: Mar. 30, 2012

(65) Prior Publication Data

US 2012/0240804 A1 Sep. 27, 2012

Related U.S. Application Data

(63) Continuation of application No. PCT/EP2010/005665, filed on Sep. 15, 2010.

(30) Foreign Application Priority Data

Sep. 30, 2009 (DE) ..... 10 2009 043 491

(51) Int. Cl.

| | |
|---|---|
| ***F42B 5/15*** | (2006.01) |
| ***F42B 3/14*** | (2006.01) |
| ***F42C 19/12*** | (2006.01) |
| ***F41J 2/02*** | (2006.01) |
| ***F42B 4/26*** | (2006.01) |
| ***F41A 19/63*** | (2006.01) |
| ***F42B 5/08*** | (2006.01) |

(52) U.S. Cl.

CPC . *F41A 19/63* (2013.01); *F41J 2/02* (2013.01); *F42B 4/26* (2013.01); *F42B 5/15* (2013.01); *F42B 5/08* (2013.01)

USPC ..... 102/360; 102/202.9; 102/202.5

(58) Field of Classification Search

USPC ..... 102/202.9, 202.5, 202.7, 202.8, 202, 102/202.12, 360

See application file for complete search history.

(56) References Cited

U.S. PATENT DOCUMENTS

| | | | | |
|---|---|---|---|---|
| 2,636,697 | A | 4/1953 | Denny | |
| 4,285,153 | A | 8/1981 | Crouch | |
| 4,586,439 | A * | 5/1986 | Wrana | 102/438 |
| 4,640,180 | A * | 2/1987 | Rose | 89/8 |
| 5,016,518 | A * | 5/1991 | Kaplan et al. | 89/8 |
| 5,183,956 | A * | 2/1993 | Rosenberg | 89/8 |
| 5,463,954 | A * | 11/1995 | Blair | 102/202 |
| 5,549,046 | A * | 8/1996 | Widner et al. | 102/202.7 |
| 5,854,439 | A * | 12/1998 | Almstrom et al. | 89/8 |
| 6,237,494 | B1 * | 5/2001 | Brunet et al. | 102/202.7 |

(Continued)

FOREIGN PATENT DOCUMENTS

| | | |
|---|---|---|
| DE | 10 2006 004 912 A1 | 7/2007 |
| DE | 10 2009 020 558 A1 | 11/2010 |
| DE | 10 2009 030 868 A1 | 1/2011 |
| GB | 823391 | 11/1959 |

*Primary Examiner* — Jonathan C Weber

(74) *Attorney, Agent, or Firm* — Muncy, Geissler, Olds & Lowe, P.C.

(57) ABSTRACT

An arc-based active body activation unit is provided. To this end, ignition of the active mass or flare is effected by means of arcing. The arc can be used immediately and is low-maintenance. For that purpose, electrode pairs are disposed around the ejector tube, at least one of which pairs serves the ignition of the arc(s). For that purpose, the electrode pairs are electronically connected via connecting lines to at least one control unit.

5 Claims, 6 Drawing Sheets

(56) References Cited

U.S. PATENT DOCUMENTS

| | | | | |
|---|---|---|---|---|
| 6,332,402 | B1 * | 12/2001 | Weise et al. | 102/472 |
| 6,332,403 | B1 * | 12/2001 | Weise et al. | 102/472 |
| 6,539,874 | B2 * | 4/2003 | Weise | 102/472 |
| 8,146,504 | B2 | 4/2012 | Wallner et al. | |
| 2001/0032563 | A1 * | 10/2001 | Weise | 102/202 |
| 2009/0007768 | A1 | 1/2009 | Wallner et al. | |
| 2011/0174182 | A1 | 7/2011 | Guth et al. | |
| 2012/0137913 | A1 | 6/2012 | Prelic et al. | |

* cited by examiner

ACTIVATION UNIT FOR MUNITIONS-FREE DECOY TARGET

This nonprovisional application is a continuation of International Application No. PCT/EP2010/005665, which was filed on Sep. 15, 2010, and which claims priority to German Patent Application No. DE 10 2009 043 491.7, which was filed in Germany on Sep. 30, 2009, and which are both herein incorporated by reference.

BACKGROUND OF THE INVENTION

1. Field of the Invention

Decoys and/or smoke grenades based on, for example, red phosphorus (RP) or nitrocellulose (NC) are used in military applications, such as smoke grenades, infrared (IR) effect aircraft decoys, etc. The RP/NC develops the smoke and IR action by burning after suitable ignition. The ignition of RP units (active matter) takes place by means of an ignition or break charge, which ensures that the bodies can ignite optimally for the particular purpose, and so can burn.

2. Description of the Background Art

The use of such a decoy target in civil air traffic is not possible owing to the munitions component, since explosive substances are not accepted in this context and international safety agreements have to be upheld.

On this basis, a new ignition concept has been developed, which enables the ignition of RP/NC flares without explosives and/or pyrophoric substances.

This new ignition concept is described in more detail in DE 10 2006 004 912 A1, which corresponds to US 20090007768, and which is incorporated herein by reference. From this, a system for protecting large airborne platforms in particular, such as aircraft, against IR-guided or radar-guided threats is known. Here, the activation or ignition of the active body is preferably carried out without contact. The launching of the active body is then performed pneumatically or mechanically. The active bodies themselves are munitions-free packages, which are ignited by hot air or a laser.

DE 10 2009 020 558, which corresponds to US 20110174182, which is incorporated herein by reference, describes an activation unit, which activates (ignites) the active substances/flare material by supplying thermal energy, wherein the use of explosives is avoided. This has an ignition tube, from which the active substances are ejected, a high-temperature activation element, which includes n heaters, which are disposed geometrically separately from each other and radially around the perimeter of an ignition tube. The material selection of the individual heating elements allows temperatures >600° C., wherein the heating elements are designed so that they allow very dynamic heating owing to low mass. To minimize heat loss and for further optimization of the thermal activation unit, ceramic inlays are provided. With this thermal optimization and an appropriate control technique, a very short response time of the heating elements is achieved, i.e. the heating time from the activation point until reaching the rated temperature is extremely short (small or low).

DE 10 2009 030 868.7 deals with an ignition or activation unit for igniting red phosphorus flares by laser. The RP flares are subjected to laser radiation with a sufficiently high power density applied to their surfaces. By absorption of the laser radiation, the temperature of the RP flares increases, which results in the ignition of a self-sustaining combustion. For an ideal ignition (activation) of the flares, the laser energy is directed to the maximum possible proportion of the surface. For this, the laser beam is expanded by suitable optics, allowing extensive distribution.

SUMMARY OF THE INVENTION

In it therefore an object of the invention to provide an activation unit that activates such active bodies for the creation of decoys.

The invention is based on the idea of creating an active body activation unit based on an electric arc. Here the ignition of the active substance or the flare takes place by means of an electric arc. The electric arc is immediately applicable and low-maintenance. The activation of the active substance takes place on an electrical basis and instantaneously.

In order to achieve the ignition temperature of the active body/active substance or its containment (e.g. of an RP and/or NC among others), a suitably high voltage is applied to one or preferably more than one electron pair, so that an electric arc is created for each electrode pair. This is focused so that it passes over the curved area of the active body or even through the active body. An arrangement of several elements for vertical ignition is also possible.

The ignition elements and electrodes are conventional devices, e.g. point electrodes, flat electrodes etc. The arrangement and the quantity of electrodes have a significant influence on the quality of the ignition.

For ignition, the active body/the active substance is passed by the electrode by means of a conveyor mechanism. The high voltage strikes through the body, creating an electric arc, which leads to the ignition of the active substance and hence to the activation of the active material.

This form of activation allows the use of decoys without explosives in the civil environment, not only in civil air traffic, but also for civil marine targets and civil land vehicles. The structural and safety requirements on decoys and dispensers without explosive substances are simple, i.e. much lower. The ignition unit or device allows a number of ignitions, whereas the classic flare is only intended for single use. The electrodes themselves are insensitive to environmental influences.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
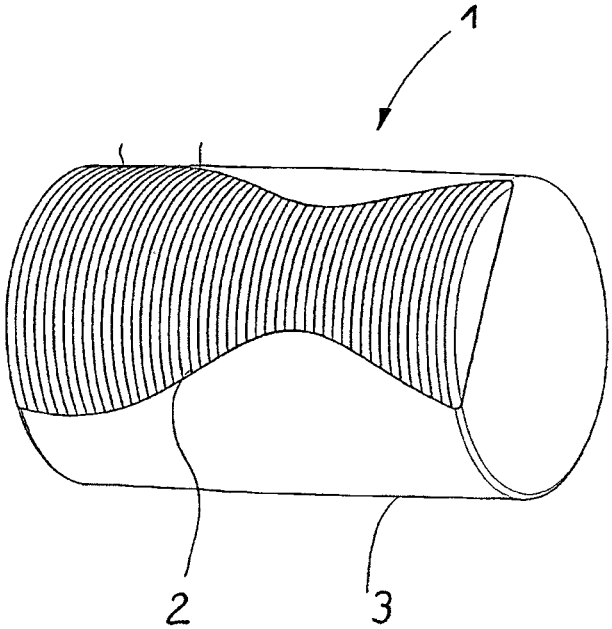
FIG. 1 illustrates an active body of individual flares.
Figure 2:
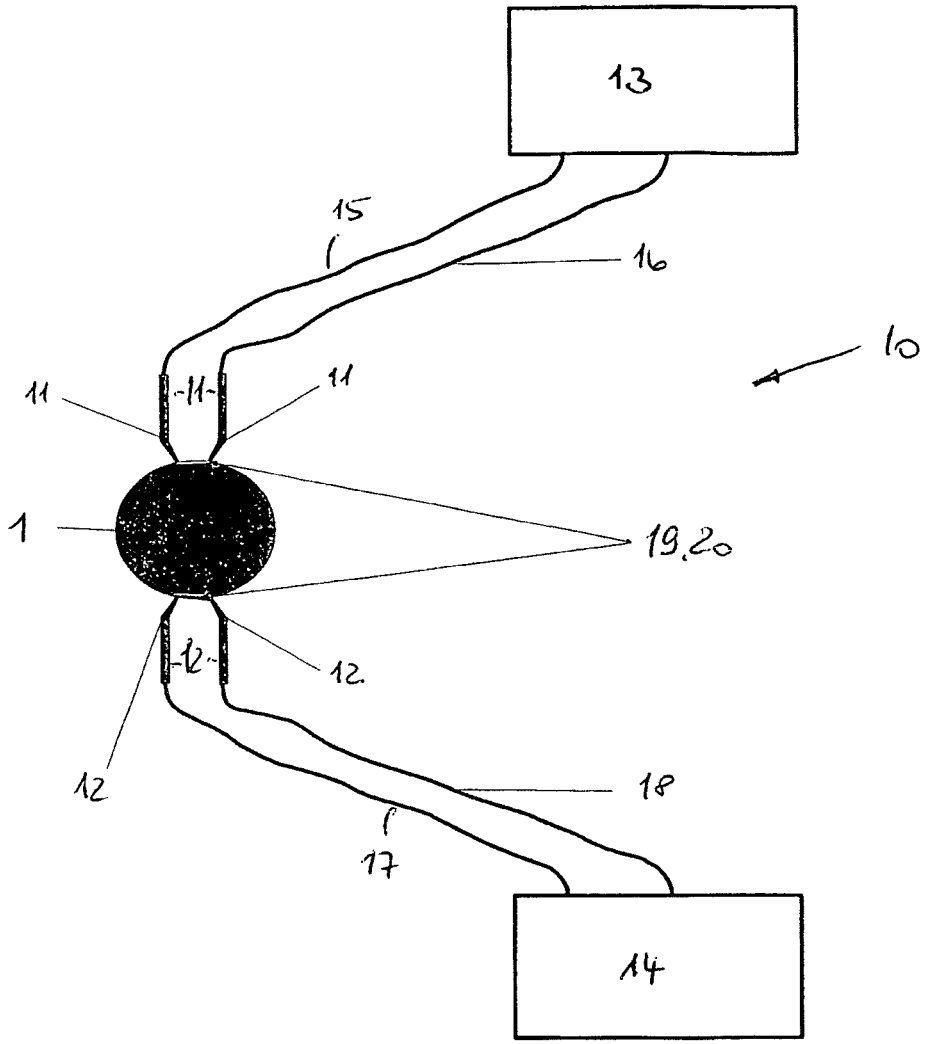
FIG. 2 illustrates an electric arc activation unit in plan view.

FIG. 1 shows an active body 1, having individual flares 2 of flammable substances provided within an outer skin 3. The individual flares 2 are ignited by an electric arc activation unit 10 (e.g. FIG. 2). For this purpose, in this embodiment, two pairs of electrodes 11, 12 are positioned relative to the active body 1 so that an electric arc 19, 20 is produced between the respective pairs of electrodes 11, 12. To generate the electric arc 19, 20, a high voltage is applied to the electrode pairs 11, 12 via a control device 13, 14 and connecting lines 15-18. FIG. 2 shows the activation unit 10 viewed along the cylinder axis of the active body 1.

For ignition the active body 1 is moved past the electrode pairs 11, 12. The electric arc ignites the flares and thus the active body or its active substance. Because the active body 1 is moved further relative to the electrode pairs, ignition takes place over a wide area (FIG. 3).

Figure 7:
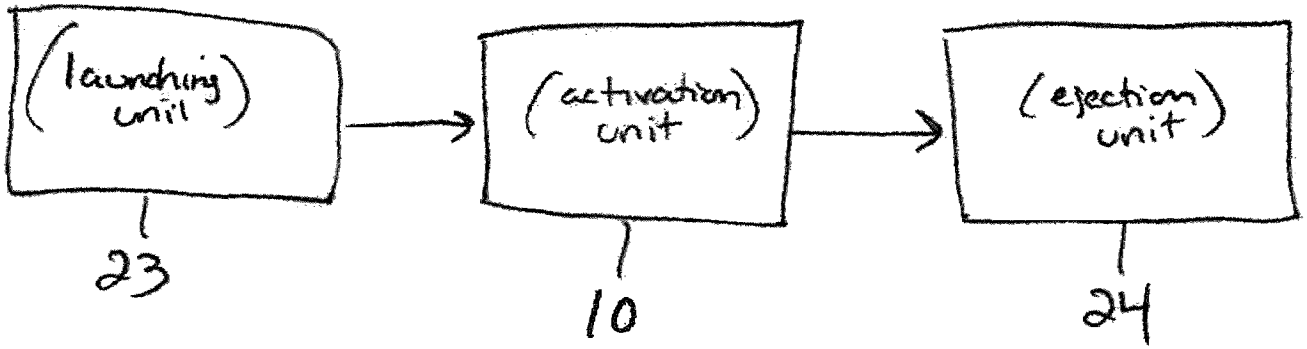
FIG. 7 illustrates an arrangement of the electric arc activation unit, ejection unit and launching unit.

The components are installed in a reusable structure/device with an ejection tube (not shown), for example, between an ejection unit 24 and a launching unit 23 of a launcher system (see FIG. 7). There are no geometric constraints on the activation unit 10. Several electrode pairs are preferably incorporated in the housing at different distances from each other. Furthermore, the electrode pairs can be geometrically distributed over the circumference of the active body 1.

Figure 4:
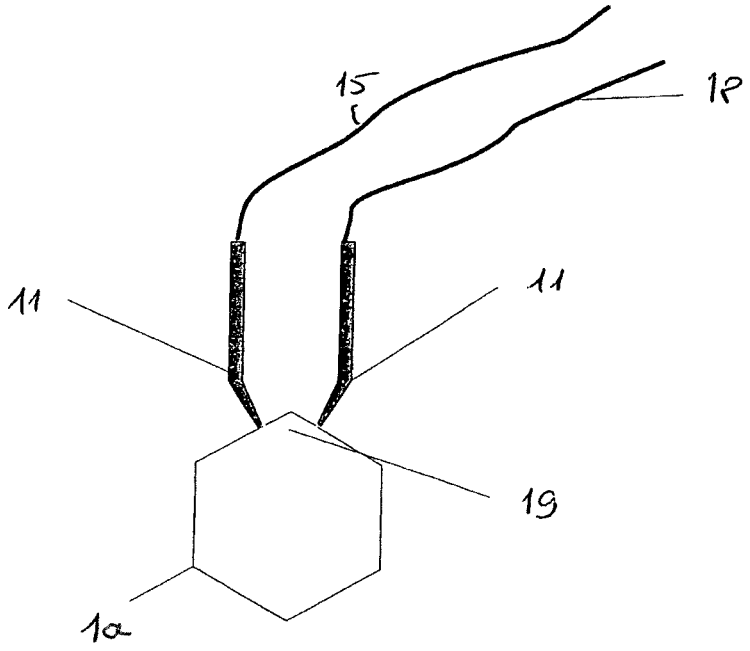
FIG. 4 illustrates an arrangement on a hexagonally cylindrical active body.

FIG. 4 shows an arrangement of at least one electrode pair 11 around a hexagonally cylindrical active body 1*a*.

Figure 3:
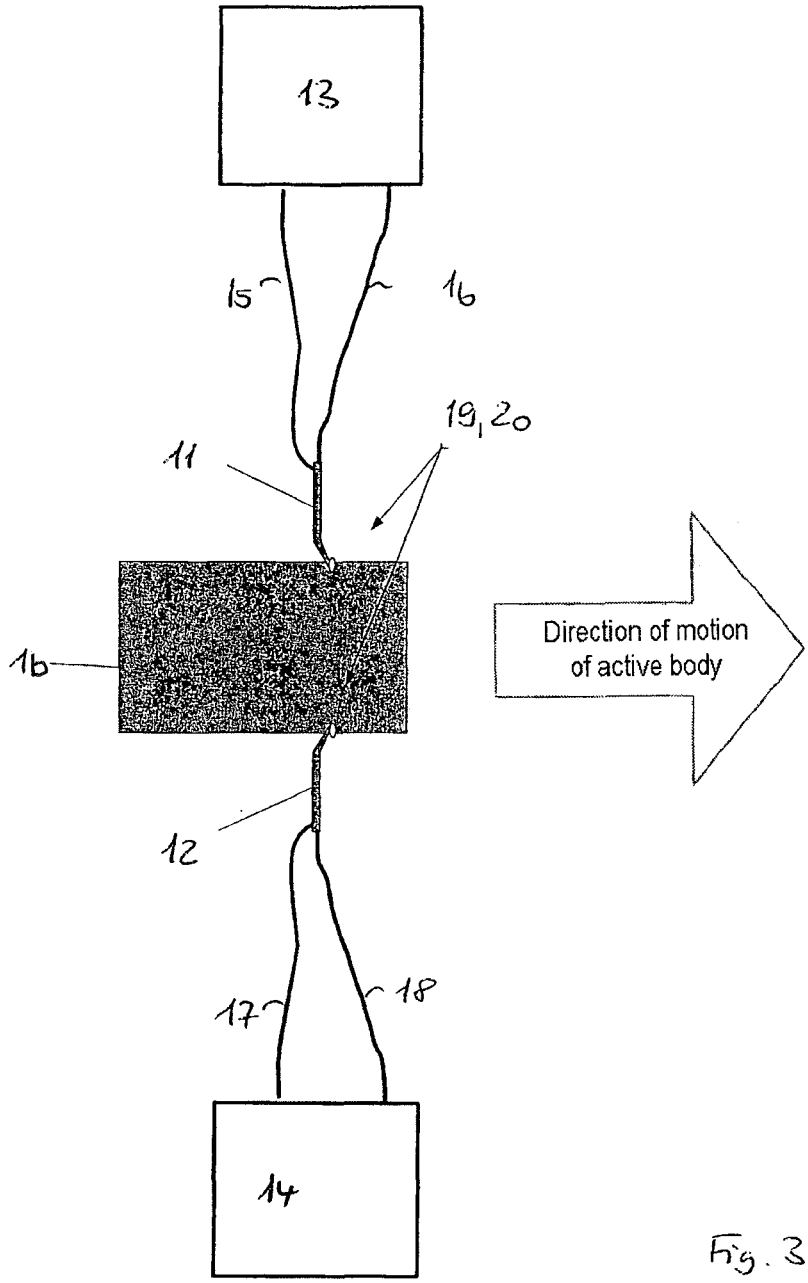
FIG. 3 illustrates the unit of FIG. 2 in a lateral illustration.

A possible arrangement of at least two electrode pairs 11, 12 with a rectangular cross section of the active body 1*b*, for example, (looking along the cylinder axis) is shown in FIG. 3.

Figure 5:
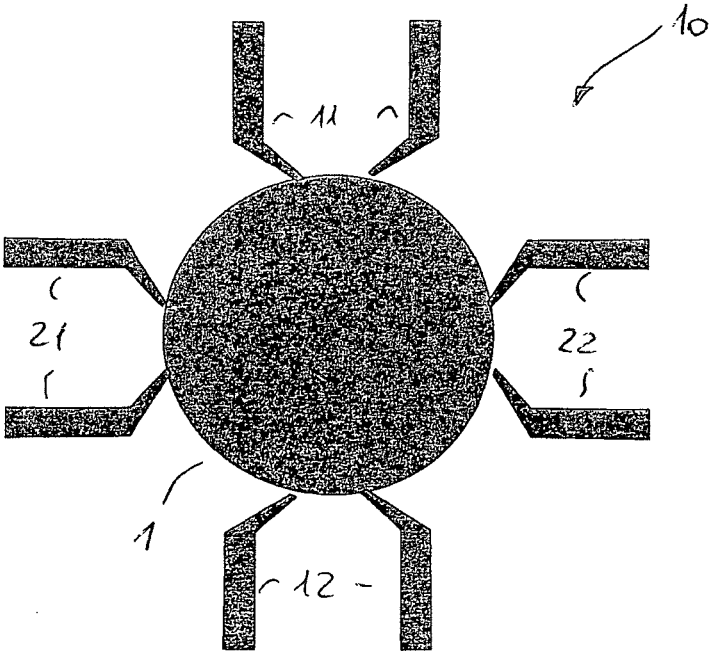
FIGS. 5, 6 is an illustration with a plurality of electrode pairs.

FIG. 5 shows a 4-fold electrode pair arrangement of the electrode pairs 11, 12, 21, 22. These can be incorporated in a common plane or even in pairs over the length of the activation unit 10 and offset with respect to each other.

Figure 6:
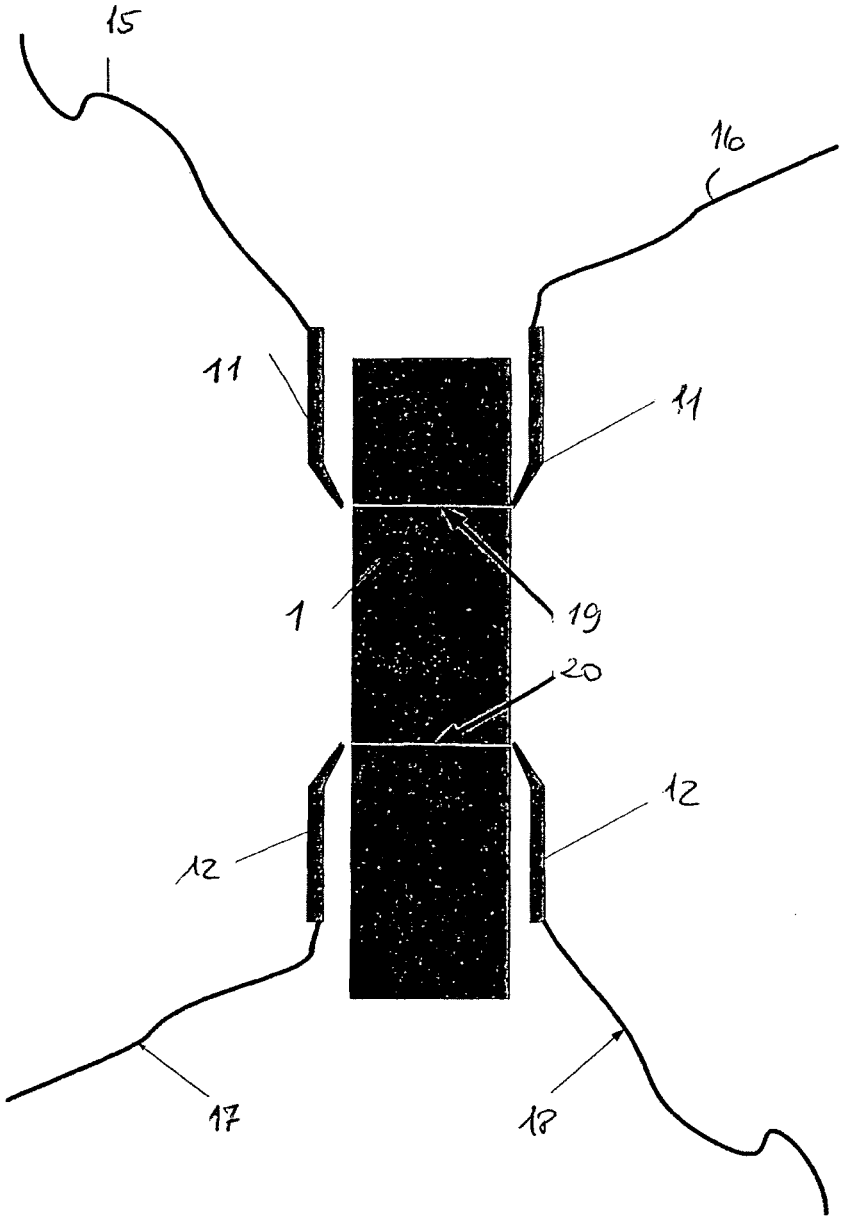

FIG. 6 shows a possible arrangement of a plurality of electrode pairs 11, 12 on an active body 1 with a rectangular cross section (looking along the cylinder axis).

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. An activation unit for munitions-free active substances, the activation unit comprising:

an active body comprised of an outer skin containing a plurality of flares therein;

at least one control device; and electrode pairs attached around the active body, at least one of the electrode pairs produces an electric arc to individually ignite the plurality of flares, wherein the electrode pairs are electrically connected by connecting lines to the at least one control device, wherein the active body is axially movable with respect to the electrode pairs, such that during movement of the active body, each of the plurality of flares are successively ignited by the at least one electrode pair.

2. The activation unit as claimed in claim 1, wherein, the electrode pairs are arranged substantially symmetrically around the active body.

3. The activation unit as claimed in claim 1, wherein, the electrode pairs are arranged in pairs at intervals over a length of the active body.

4. The activation unit as claimed in claim 1, wherein, the electric arc is aligned so that it passes over a curved area of the active body or through the active body.

5. An activation unit for munitions-free active substances, the activation unit comprising:

an active body comprised of an outer skin containing at least one flare therein, the at least one flare containing the munitions-free active substances;

at least one control device; and at least one pair of electrodes attached around an exterior surface of the active body, the at least one pair of electrodes produces an electric arc to ignite the at least one flare, wherein the at least one pair of electrodes is electrically connected by connecting lines to the at least one control device, wherein the active body is axially movable with respect to the at least one pair of electrodes, such that during movement of the active body, each of the plurality of flares are successively ignited by the at least one pair of electrodes.

* * * * *